United States Patent [19]

Rapp et al.

[11] 4,338,681

[45] Jul. 6, 1982

[54] ELECTRIC TIMING CLOCK

[75] Inventors: Egon Rapp, Schramberg; Heinrich Oertel, St. Georgen, both of Fed. Rep. of Germany

[73] Assignee: Gebruder Junghans GmbH, Schramberg, Fed. Rep. of Germany

[21] Appl. No.: 118,091

[22] Filed: Feb. 4, 1980

[30] Foreign Application Priority Data

Feb. 8, 1979 [DE] Fed. Rep. of Germany ..... 2904744

[51] Int. Cl.[3] ..... G04B 23/02; G04C 21/16

[52] U.S. Cl. ..... 368/72; 368/252

[58] Field of Search ..... 368/72–74, 368/250–254, 109, 75

[56] References Cited

U.S. PATENT DOCUMENTS

| | | | |
|---|---|---|---|
| 468,414 | 2/1892 | Burroughs | 368/109 |
| 506,625 | 10/1893 | Case | 368/72 |
| 3,678,678 | 7/1972 | Macedo | 368/252 |
| 4,283,782 | 8/1981 | Tamaru et al. | 368/72 |

FOREIGN PATENT DOCUMENTS 7511417 4/1975 Fed. Rep. of Germany .

*Primary Examiner*—Vit W. Miska

*Attorney, Agent, or Firm*—Scully, Scott, Murphy & Presser

[57] ABSTRACT

An electric, particularly battery-operated timing clock which includes electric time setting components for an electrical switching device arranged about a clock dial. A signal emitter is adapted to be actuated by the switching device. In order to actuate the signal emitter at preselectable time periods, a contact switch element which rotates about the hour-hand shaft of the clock forms, through a contact path and a slide contact, one pole of the switching device, the other pole of which is formed by an electrically-conductive segmented ring with radial segments. Each segment includes a free end actuatable through a latchable setting component, and a contact finger which projects into the path of movement of the contact switch element upon actuation of the free end.

13 Claims, 12 Drawing Figures

ELECTRIC TIMING CLOCK

BACKGROUND OF THE INVENTION

1. Field of the Invention

The present invention relates to an electric clock, and more particularly, to a battery-operated clock incorporating time setting means arranged about a clock dial for an electrical switch arrangement, through the intermediary of which it is possible to actuate a signal transmitter.

2. Discussion of the Prior Art

In U.S. Pat. No. 2,096,620 there is described an electric clock of the above-mentioned type through which a radio receiver is to be actuated. The mechanical construction for the actuation of the electrical switching device which is connected to the input of the radio apparatus is particularly significant in that the force which is necessary for the actuation of the electrical switch contact must be produced by a spring which is tensioned by the clockwork.

Described in German Laid-open Patent Application No. 16 15 034 is an electric switch clock in which there are arranged radially displaceable switching slide contacts. These switching slide contacts rotate so as to actuate an electrical microswitch through a switching lever in conformance with their switching position. In order to set the indexing slide contacts to the desired switching intervals, then adjacent the clock dial there must be provided a separate scale which rotates in conjunction with the slide contacts. This is contrary to a logical setting capability and setting control.

SUMMARY OF THE INVENTION

Accordingly, it is an object of the present invention to provide a dial clock of the above-mentioned type in which it is possible to actuate a signal transmitter at preselectable time intervals through the use of simple means.

Inventively, the foregoing object is attained in that a contact element which rotates in conjunction with the hour-hand shaft forms a first pole of the switch arrangement through a contact path and a slide contact, wherein the other pole of the switch arrangement is formed by an electrically-conductive segmented ring having radial segments, and in which each segment includes a free end actuatable through a latchable setting device and a contact finger, which upon actuation of the free end projects into the path of movement of the contact element. Hereby, it is advantageous that this will eliminate the need for an additional electrical switch for the switch arrangement and wherein the association between the time setting means and the clock dial will not change during the course of time.

In a preferred embodiment of the invention, the slide contact includes three contact tongues which press on a disc in the axial direction of the hour-hand shaft. Afforded in this manner, on the one hand, is an assured contacting while, on the other hand, this will eliminate any axial play of the time display.

BRIEF DESCRIPTION OF THE DRAWINGS

Further advantageous embodiments of the present invention may now be ascertained from the following detailed description, taken in conjunction with the accompanying drawings; in which.

DETAILED DESCRIPTION

Figure 1:
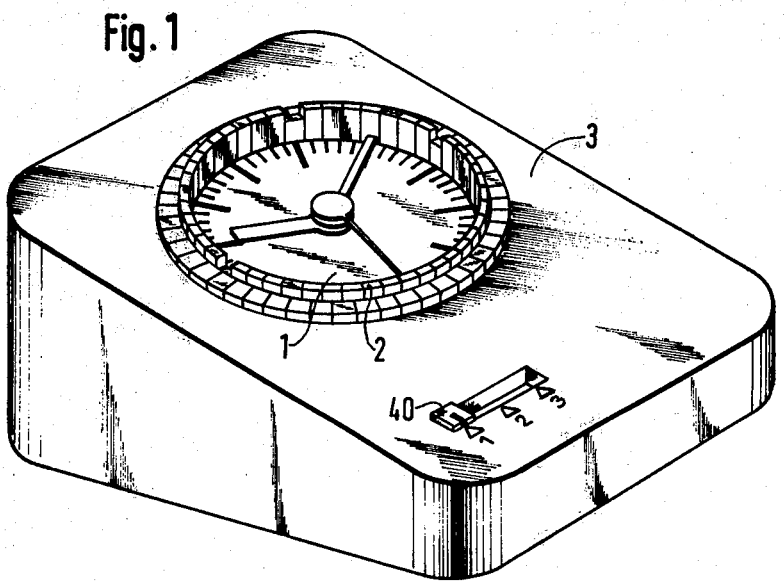
FIG. 1 illustrates a perspective view of a clock with setting elements arranged about the clock dial.
Figure 2:
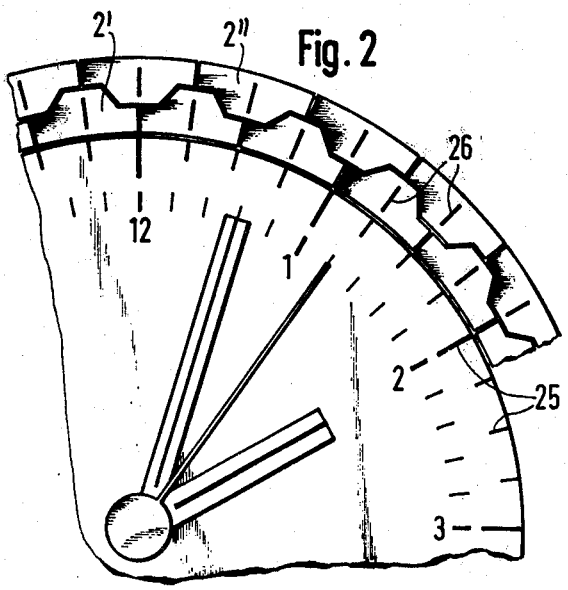
FIG. 2 is a modified embodiment of the setting elements.

In a battery-operated clock according to FIG. 1; forty-eight push buttons 2 are arranged about a clock dial 1; in essence, one push button for each quarter-hour. In the embodiment pursuant to FIG. 2, inner push buttons 2′ and the outer push buttons 2″ are arranged so as to be displaced relative to each other. This renders it possible to also provide one push button for each quarter-hour, however, the push buttons can be constructed to have a larger surface in contrast with the arrangement according to FIG. 1, so as to be more simple to actuate.

Within a housing 3 of the clock, a known battery-operated general known clockwork 5 is mounted on a clockwork support 4. The clockwork support 4 is positioned and supported on the housing 3 through latching or screwing onto uprights 6. Illustrated in FIG. 3 is merely one of the uprights or supports 6.

Figure 3:
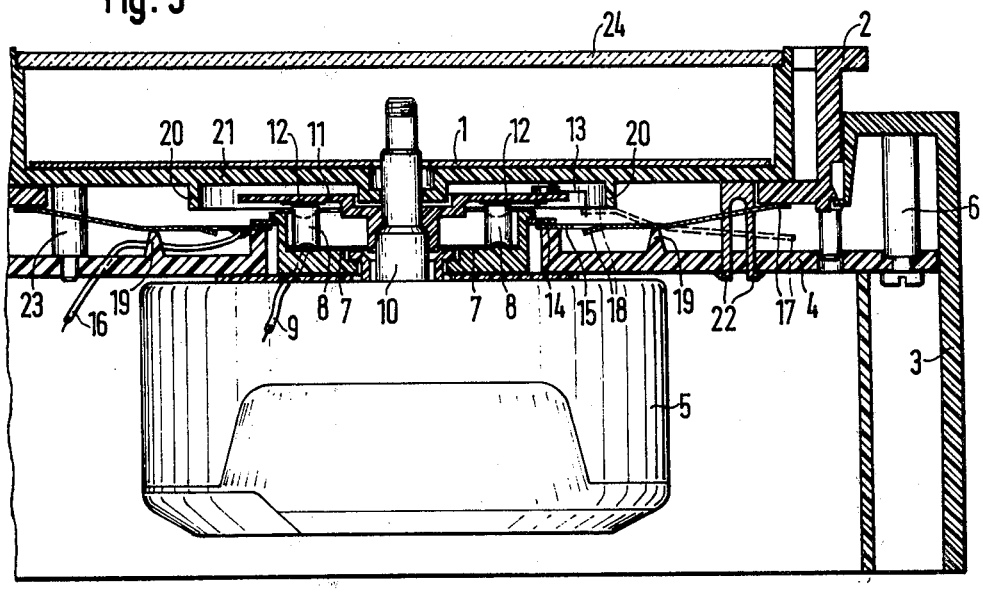
FIG. 3 is a sectional view through the clock of FIG. 1.
Figure 7:
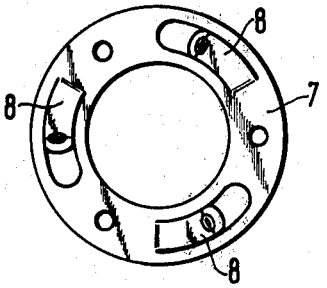
FIG. 7 illustrates a plan view of a slide contact.

Seated on the clockwork support 4 is a slide spring ring 7 having contact tongues 8 (refer to FIGS. 3 and 7). Soldered to the slide spring ring 7 is a conductor 9.

A disc 11 is pressed onto the hour-hand shaft 10 of the clockwork 5, on the lower surface of which there is provided a contact path 12 against which there will contact the contact tongues 8. Through intermediary of the contact tongues 8, on one hand, the conductor 9 is electrically connected with the contact path 12 in every rotational position of the disc 11.

On the other hand, as a result of the pressure being exerted by the contact tongues 8 against the disc 11, there is eliminated the axial play of the hour-hand shaft 10.

Figure 5:
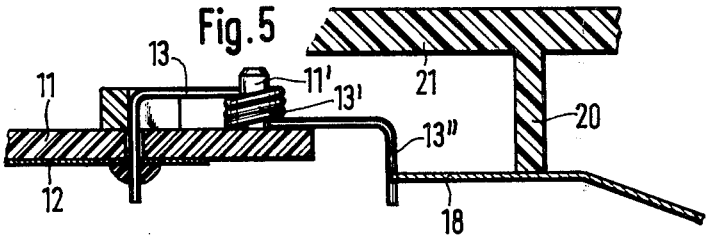
FIG. 5 is an enlarged fragmentary section through a contact element as shown in FIG. 3.

Provided on the disc 11 so as to project thereover is a contact element or switch 13 whose one end is soldered together with the contact path 12 (refer to FIGS. 3, 5). The contact element 13 extends in a few windings 13′ about a pin 11′ projecting from the disc 11. One free end 13″ of the contact element 13 is bent downwardly.

Retained on the clockwork support 4 through a securing disc 14 is a segmented ring 15 along its inner circumference. A further conductor 16 is pressed between the securing disc 14 and the segmented ring 15 or, in any other manner, conductively interconnected with the segmented ring 15.

Figure 4:
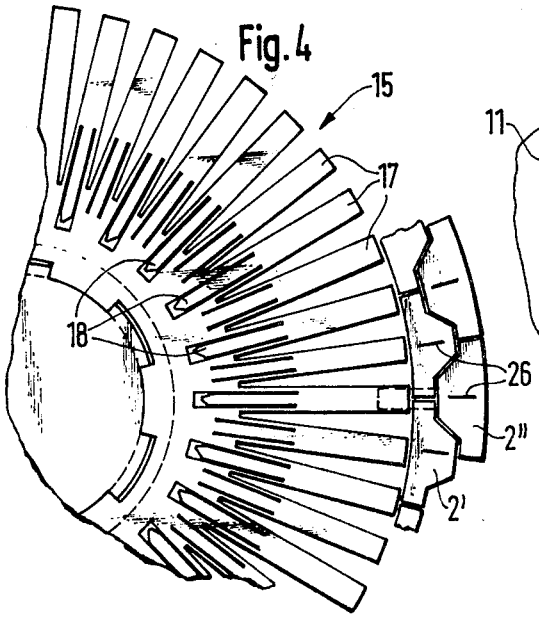
FIG. 4 is a segmented ring of the clock.

The number of the segments of the segmented ring 15 is equal to the number of the touch or push buttons 12. Each segment evidences a free end 17 and a contact finger 18. The segmented ring 15 can be easily constructed from a stamped element (refer to FIG. 4).

The contact fingers 18 of the segments lie on protuberances 19 so that, upon depression of the associated free end 17 of the pertinent segment, the applicable contact finger will deflect upwardly so as to push against a stop 20. In FIG. 3 there is clearly shown the two possible positions of the free end and the contact finger of one segment. When the contact finger 18 lies against the stop 20 it projects into the path of movement of the contact element 13 which rotates together with the hour-hand shaft 10.

The stop 20 is so formed on a support plate 21 which is retained on the clockwork support 4 through locking projections 22 and oriented and supported thereon by centering pins 23. The clock dial 1 is fastened on the support plate 21. The support plate 21 also carries a covering glass 24. Concurrently, the support plate 21 serves for the radial guidance of the clock hands. Printed on the cover glass 24 is a quarter-hour division scale 25 (refer to FIG. 2) in which the quarter-hour division scale 25 is in alignment with corresponding markings 26 on the push buttons 2.

Figure 6:
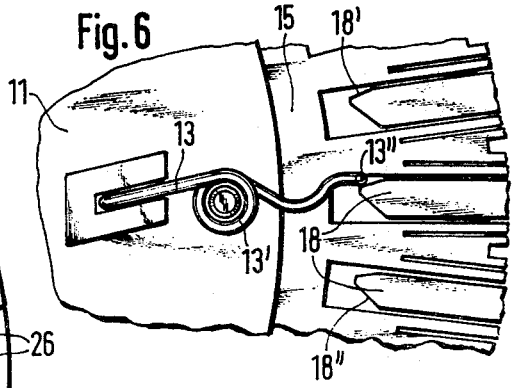
FIG. 6 is a plan view of the contact element of FIG. 5.

Illustrated in FIG. 6 is the oppositely arranged position of the free end 13'' of the contact element 13 and one contact finger 18 which projects into its path of movement. The free end 13'' of the contact element 13 engages against an inclined surface 18' of the contact finger 18. During the continued movement of the contact element 13 in a clockwise direction this will deflect under the resilient effect of its windings 13' and will thereby spring in front of a subsequent inclined surface 18'' of the contact finger 18.

Figure 8:
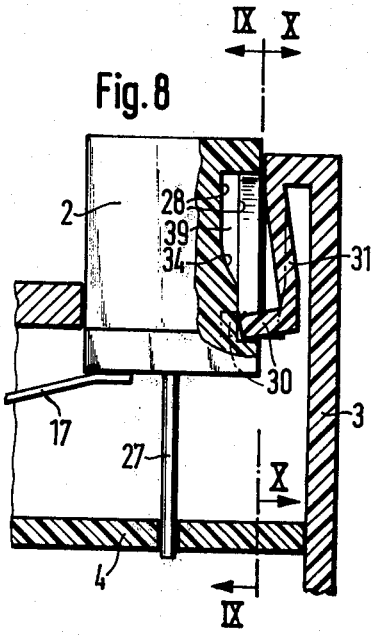
FIG. 8 is an enlarged scale sectional view through a setting element as shown in FIG. 3.
Figure 9:
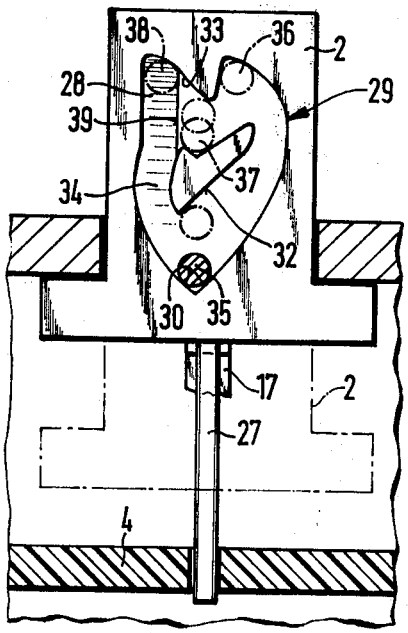
FIG. 9 is a view of the setting element taken along line IX—IX in FIG. 8.
Figure 10:
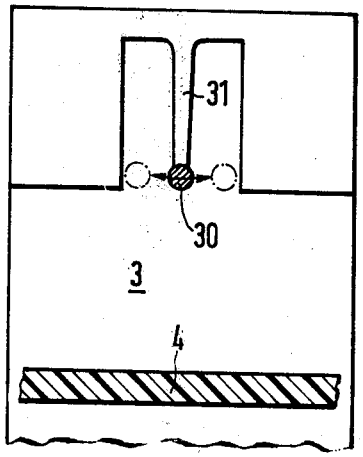
FIG. 10 is a view of the setting element taken along line X—X in FIG. 8.

Each free end 17 of the segmented ring 15 is located beneath a push button 2. In FIGS. 8 through 10 there is illustrated in detail the construction of the push buttons 2 and of their latching.

The push button 2 is equipped with a guide pin 27 which is supported in the clockwork support 4 and is pressed into its upper position by the free end 17 of a segment.

A heart-shaped or cardioid cam 29 with a bottom 28 is formed on the push button 2, into which there projects a pin 30 which is formed on a spring arm 31. The spring arm 31 and the pin 30 are sprayed integrally with the housing 3. The spring arm 31 is so constructed as to be resilient in the plane of the cardioid cam 29 as well as perpendicular thereto. The cardioid cam 29, in essence, includes 3 guide cams 32, 33 and 34 and four corner regions 35 through 38. The bottom 28 of the cardioid cam is hereby located lower in the corner region 38 than in other corner regions. Formed hereby is a run-off edge 39.

Arranged within the housing 3 of the herein described timing clock is an electrical signal emitter (not shown in detail) for example such as a buzzer or an electronic gong. When employing an electronic gong which can play different tone sequences, there is provided a signal selector switch 40 (FIG. 1), by means of which there can be selected the currently desired tone sequence. One of the described conductors 9 or 16 is connected to the battery. The other conductor 16 or 9 is connected with the electrical signal emitter.

The operation of the described clock is as follows:

The user can depress one or more of the push buttons 2. At an undepressed button the pin 30 is under the spring effect of the free end 17 in the corner region 35. When a push button is depressed, then the guide cam 32 travels along the pin 30 whereby the latter will displace, in FIG. 9 towards the right. The push button 2 will find its stop as soon as the pin 30 is located in the corner region 36. After the subsequent release of the push button 2, the latter will lift to some extent under the effect of the free end 17 of a member, until the corner region 37 will impact against the pin 30 (refer to FIG. 9). When the push button 2 is now again depressed, then guide cam 33 will travel along the pin 30 whereby the latter is displaced, towards the left in FIG. 9. As soon as the corner region 38 impacts against the pin 30, then the pin 30 will spring, towards the left in FIG. 8, behind the run-off edge 39 so that the restoring force of the spring arm 31 cannot become effective. At the following release of the push button 2, the pin in the guide cam 34 will slide along the run-off edge 39 under the spring force of the free end 17. The push button 2 is thus moved into its initial position in which the pin 30 is located in the corner region 35.

As long as the corner region 35 of the cardioid cam 29 of a pressure button 2 impacts against a pertinent pin 30, then this button 2 will be retained in its depressed position. This push button 2 will then also retain the free end 17 of the pertinent segment of the segmented ring 15 in a depressed position so that the associated contact finger 18 is lapped over the protuberance 19 into the path movement of the contact element 13.

The contact element 13 is so adjusted as to fleetingly lie below the hour-hand of the timer clock. For instance, proceeding from the push buttons 2 which are shown as depressed in FIG. 1 at 1 o'clock, 3 o'clock and 9 o'clock, then the appropriate contact fingers 18 project into the path of movement of the contact element or switch 13. Always, when the hour-hand indicates a time, the associated push button of which is depressed, then the free end 13'' of the contact switch element 13 will impact against the raised contact tongue 18. As a result there will close the current circuit leading through the conductor 9, the slide spring ring 7, the contact tongues 8, the contact path 12, the free end 13'' of the contact element 13, the contact finger 18 of the segmented ring 5, and the conductor 16. Accordingly, there will be sounded a signal by the signal emitter. The user is thus made aware of a preset time.

In order to shut off the signal tone it is merely necessary to again depress the applicable push button 2 so that the corner region 35 of the cardioid cam 29 will again impact against the pin 30. Hereby, the pertinent contact finger 18 will, under the restoring force of the segmented ring 15, spring out of the path of movement of the contact element 13 so as to interrupt the electrical circuit.

When the push button 2 is not actuated for the termination of the signal, then the signal will itself end after a few minutes, since the free end 13'' of the contact element 13 which rotates in conjunction with the hour-hand will snap over the contact finger 18. The next signal will be sounded at the subsequently set point in time.

In the described time clock it is possible to set or terminate the user in a simple and logical manner a large number of quarter-hourly timings. For this purpose it is not necessary to supply electronic storage means and no complex electro-mechanical switch devices since the same constructional components assume the mechanical storage function and electrical switching function.

Figure 11:
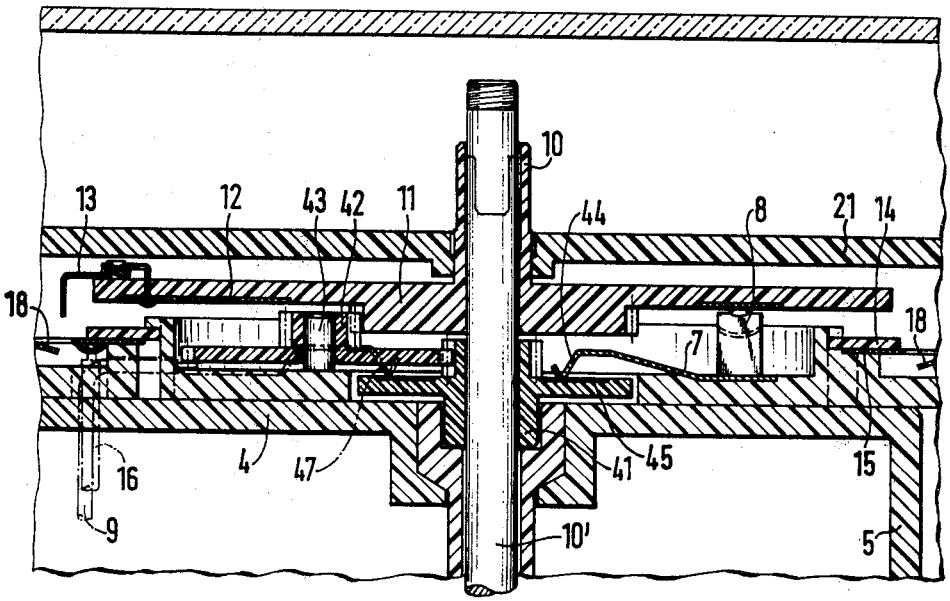
FIG. 11 is another embodiment of the invention.
Figure 12:
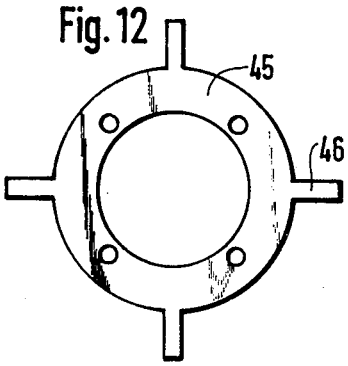
FIG. 12 is a contact ring of the embodiment of FIG. 11.

Illustrated in FIGS. 11, 12 is an exemplary embodiment of the invention in which there is improved the precise initiation of the signal. Seated on a minute-hand shaft 10' of the clock is a minute disc 41 which drives the disc 11 through a gear 42 on which there is formed the hour-hand shaft 10. The gear 42 is supported on a pin 43 on the clockwork support 4.

The slide spring ring 7, in addition to the described contact tongue 8 includes a further contact tongue 44 which is located on a contact ring 45 of the minute disc 41. The contact ring 45 is provided with four projections 46 which are displaced relative to each by 90° and which extend star-shaped in the plane of the contact ring 45. The projections 46 have a contact element 47 associated therewith which is connected with the conductor 9. The contact element 47 is illustrated in phantom lines in FIG. 11. The element is so offset with respect to the gear 42 that both components will not contact each other.

The described embodiment according to FIGS. 11, 12 operates, to the extent as has not been previously described, as follows:

Exactly at the beginning of each quarter-hour will the contact element 47 contact one of the projections 46. The contact switch element 13 is then electrically-conductively connected with the conductor 9 through the contact ring 45, the further contact tongue 44, the contact tongues 8, and the contact path 12. In the event that at this point in time there is also raised the applicable contact finger 18, then the contact switch element 13 will impact against the former and a signal output is effected. The advantage of the embodiment pursuant to FIGS. 11 and 12 consists of in that the initiation of the signal is effected precisely within minutes.

Through the dimensioning of the width of the projections 46 there can be limited the maximum duration of the signal output precisely within minutes.

Within the scope of the invention there can also be contemplated numerous other embodiments. Thus, for example, it is possible to form the disc 11 as a contact arm which has a tongue slide along a contact path. It is also possible to design the buttons 2 in a twenty four-hour arrangement. In case of need the push buttons 2 and the segmented ring 15 can be constructed that there is achieved a shorter or lengthier than quarter-hourly timing input. Moreover, it is possible that, for example, the spring arms 31 with the pins 30 be formed integrally with the support plate 21 or the clockwork support 4. A construction of that type can be selected when the push buttons are mutually offset pursuant to the embodiment of FIG. 2. It is also possible to arrange the cardioid cams 29 on the stationary components and the spring arms 31 with the pins 30 on the push buttons 2. In addition thereto, when the described push button 2 is employed independently of the described switching clock, in lieu of the free end 17 which effects the return position of the push button, there can be provided a compression spring which encompasses the guide pin 27.

What is claimed is:

1. An electric clock having an hour hand on an hour hand shaft and an electrical switching device which includes a plurality of time setting means (2) arranged about a clock dial (1), which are selectively manually displaceable at preselected time points between on and off positions, wherein each time setting means (2), has an associated contact finger (18) extending radially below the clock dial (1), with a ring shaped conductive connection of the contact fingers (18) to each other, and wherein a contact maker (13) is provided rotating with the hour hand, characterized in that said contact fingers (18) are elastic segments on a segmented ring (15) and are pivotally maintained projecting into the path of rotation of said contact maker (13) when an associated time setting means (2) is engaged in an on position and acts on the opposite free segment end (17), and said contact maker (13) is resiliently deflected opposite to the path of its rotational movement by the contact fingers (18) pivoted into its path of movement.

2. Clock as claimed in claim 1, comprising a disc on said hour-hand shaft for carrying said contact maker towards a contact path, said disc being contactable through a sliding contact.

3. Clock as claimed in claim 2, said sliding contact comprising three contact tongues pressing against said disc in the axial direction of said hour-hand shaft.

4. An electrical clock as claimed in claim 1 or 2 or 3, characterized in that the time setting means (2) are constructed across the free segment ends (17) parallel to the axis of the hour hand shaft (10) as pushbuttons (2) with latching positions for on and off positions.

5. Clock as claimed in claim 1, each said segment of said segmented ring being supported on a protuberance intermediate said contact finger and said free end.

6. Clock as claimed in claim 1, comprising means for contacting said segmented ring along the inner circumference thereof.

7. Clock as claimed in claim 1, comprising stop means for said contact fingers in the positions projecting into the path of movement of said contact maker.

8. Clock as claimed in claim 1, comprising a minute-hand shaft; a contact ring rotating about said minute-hand shaft, a slide contact extending along said contact ring; and a stationary contact element associated with said contact ring, said contact ring electrically connecting said slide contact and said contact element at angular positions which correspond to the beginning of a unit of an hour-division selectable through said setting means.

9. Clock as claimed in claim 8, said contact ring comprising radial projections for electrically connecting said slide contact with said contact element.

10. Clock as claimed in claim 1, each said setting means comprising a pushbutton having a cardioid cam; a pin resiliently mounted in two planes engaging into said cam, said cardioid cam including a run-off edge for said pin.

11. Clock as claimed in claim 10, each said pushbutton being resiliently maintained in the position by an associated free end of said segmented ring in which the associated contact finger does not project into the path of movement of the contact switch element.

12. Clock as claimed in claim 10, said pin being formed on a spring arm constructed integrally with a supporting component of said clock.

13. Clock as claimed in claim 10, said pushbuttons being mutually offset along the circumference of said clock dial.

* * * * *